US005823154A

United States Patent [19]

Kuhn et al.

[11] Patent Number: 5,823,154

[45] Date of Patent: Oct. 20, 1998

[54] INTERNAL COMBUSTION ENGINE WITH A CAM DRIVE

[75] Inventors: Uwe Kuhn, Riederich; Juergen Kirschner, Wimsheim; Sandro Soccol, Bietigheim-Bissingen, all of Germany

[73] Assignee: Robert Bosch GmbH, Stuttgart, Germany

[21] Appl. No.: 894,832

[22] PCT Filed: Aug. 27, 1996

[86] PCT No.: PCT/DE96/01584

§ 371 Date: Aug. 29, 1997

§ 102(e) Date: Aug. 29, 1997

[87] PCT Pub. No.: WO97/24514

PCT Pub. Date: Jul. 10, 1997

[30] Foreign Application Priority Data

Dec. 30, 1995 [DE] Germany ..... 195 49 221.8

[51] Int. Cl.[6] ..... F01M 9/10; F01L 1/18

[52] U.S. Cl. ..... 123/90.33; 123/90.36; 123/90.42; 123/508; 123/196 M; 184/6.5

[58] Field of Search ..... 123/90.33, 90.35, 123/90.39, 90.36, 90.42, 507, 508, 196 R, 196 M; 184/6.5, 6.9

[56] References Cited

U.S. PATENT DOCUMENTS 5,127,374 7/1992 Morel, Jr. et al. ..... 123/90.35
5,394,842 3/1995 Kobayashi ..... 123/90.36
5,566,652 10/1996 Deppe ..... 123/90.36
5,588,413 12/1996 Stone et al. ..... 123/508

FOREIGN PATENT DOCUMENTS 275715 7/1988 European Pat. Off. .
3933119 4/1991 Germany .
4334505 4/1994 Germany .
280024 10/1927 United Kingdom .

*Primary Examiner*—Weilun Lo
*Attorney, Agent, or Firm*—Edwin E. Greigg; Ronald E. Greigg

[57] ABSTRACT

The invention relates to an internal combustion engine having a cylinder head with a cam drive, which has a rocker arm pivotably supported in the cylinder head. A roller is supported in the rocker arm in which the roller rolls on a cam path of a cam of a camshaft and is intended for the drive of reciprocating components. The roller is supported in the rocker arm on a roller bolt which on at least one face end has a bore leading to the bearing point of the roller, to which bore lubricant can be delivered on the face end upon execution of a reciprocating motion by a lubricant delivery device associated in the region of the reciprocation path executed by the bore.

20 Claims, 2 Drawing Sheets

INTERNAL COMBUSTION ENGINE WITH A CAM DRIVE

PRIOR ART

The invention is based on an internal combustion engine having a cam drive.

In one such engine, known from German Published, Non-Examined Patent Application DE-OS 38 26 144 A1, each cylinder of the engine to be supplied is assigned a separate fuel injection device. This device is controlled via a cam drive, which has a lever arm pivotable about a fixed bearing point. A roller that rolls on a cam path of a cam shaft precedes this rocker arm and transmits raising and lowering motions to a drive part that is operatively connected to the fuel injection device.

Such an arrangement, however, has the disadvantage that both the rocker arm and the roller rotatably supported in the rocker arm have no bearing lubrication, and thus because of the high forces to be transmitted there is major wear between the parts that are rotationally movable with respect to one another, which can cause inoperativeness or even seizing.

To enable lubricating such bearing locations, it is also already known from the general prior art that in stationary bearings, a direct delivery of lubricants to such bearings is made possible.

In bearings of components that move along a curved path, such as the roller in the rocker arm, it is often only very complicated or even impossible to deliver lubricants because of the reciprocating motion, so that these parts, because of their high wear, have a short service life.

ADVANTAGES OF THE INVENTION

The internal combustion engine according to the invention has the advantage over the prior art that a roller supported in the rocker arm can be supplied with lubricant, through a lubricant nozzle disposed in the region of a curved path of the roller, via a bore disposed in the roller bolt. As a result, at least at the moment when the roller bolt supported in the rocker arm passes over a lubricant supply point, lubricant can be picked up. The lubricant is advantageously sprayed in the direction of the bearing location, so that lubricant particles can enter the bore and thus get between the roller and the roller bolt for lubrication purposes. At the same time, this kind of lubricant delivery can contribute to lubrication of the roller bolt for the rocker arm, in the case of a rotatably supported roller bolt.

In an advantageous feature of the invention, where a roller bolt is supported on a rocker arm in a manner fixed against relative rotation, it is provided that the radially extending transverse bore is disposed pointing away from the cam path, so that lubricant can be delivered with certainty to the bearing location.

In another advantageous feature of the invention, it is provided that in the case of a rotatably supported roller bolt, at least one transverse bore is provided that completely penetrates the roller bolt. As a result, it can be assured that when the roller bolt is rotating as well that adequate lubrication can exist between the roller bolt and the roller.

In another advantageous feature of the invention, it is provided that the bore oriented toward the lubricant delivery device has a funnel-shaped opening. As a result, upon overtaking by the lubricant delivery device, a greater amount of lubricant can be received and supplied.

In another advantageous feature of the invention it is provided that the lubricant delivery device can be disposed in a region in which the roller passes through a bottom dead center position of the cam. This is the position having the least bearing load between the roller and the roller path, so that the supplied lubricant can have a better distribution between the roller and the roller bolt.

The lubricant delivery according to the invention to a cam drive may be used in fuel injection systems or for the drive of gas exchange valves of the internal combustion engine.

BRIEF DESCRIPTION OF THE DRAWING

Exemplary embodiments of the invention are shown in the drawing and described in further detail in the ensuing description.

DESCRIPTION OF THE EXEMPLARY EMBODIMENT

Figure 1:
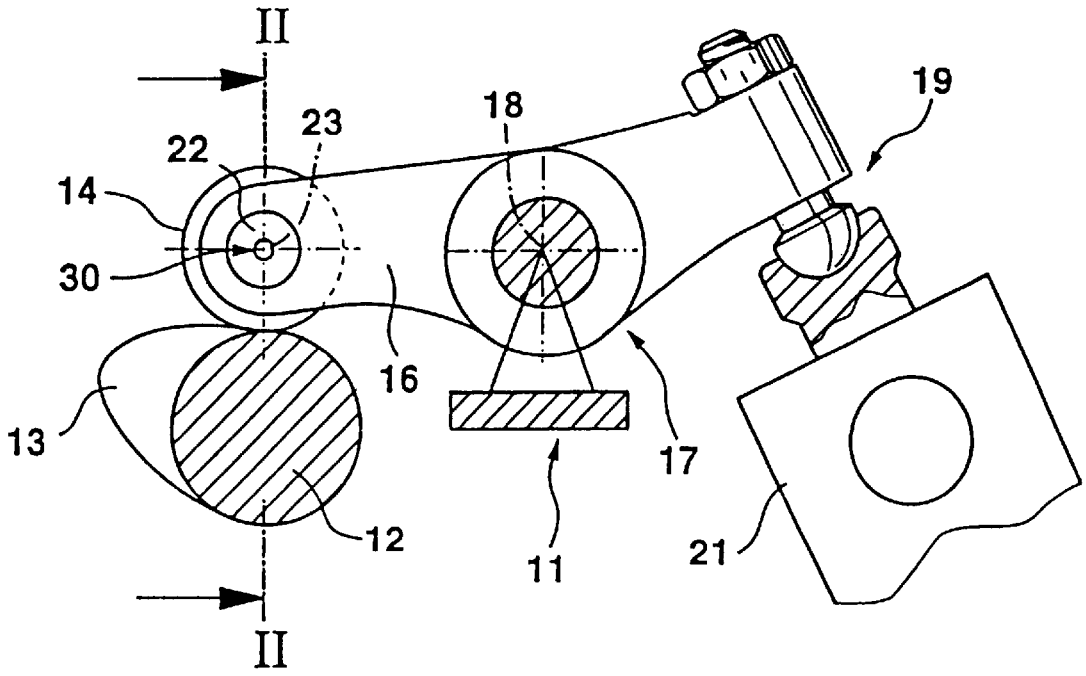
FIG. 1 is a schematic side view of a cam drive according to the invention of an internal combustion engine.

FIG. 1 shows a detail of a cylinder head of an internal combustion engine, which has a cam drive 11; only those parts essential to the invention are shown. Disposed inside the cylinder head of the engine is an encompassing camshaft 12 with a cam 13 having a cam path. This cam, via a roller 14 rolling on the cam path, actuates a rocker arm 16 which is supported via a bearing 17 in a manner fixed against relative rotation with regard to the cylinder head. The rocker arm 16 is disposed pivotably about the bearing shaft 18 and actuates a unit fuel injector 21 via a drive element 19. This kind of cam drive 11 can also be used to drive valve controllers, pump pistons, or the like.

The roller 14 is supported rotatably on a roller bolt 22 about a pivot axis 23 that simultaneously forms a longitudinal center axis of the roller bolt 22. For a specific application, the roller bolt 22 may be supported in the rocker arm 16 either in a manner fixed against relative rotation or freely rotatably.

Figure 2:
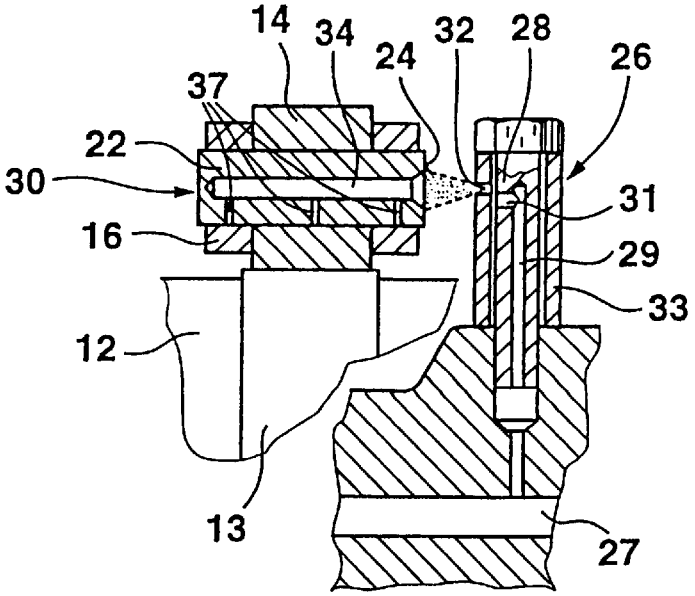
FIG. 2 is a schematic section taken along the line II—II of FIG. 1 with a lubricant delivery device.

FIG. 2 shows a schematic sectional view along the line II—II of FIG. 1. Opposite an end face 24 of the roller bolt 22 is a lubricant delivery device 26. This lubricant delivery device 26 can be connected to a lubricant supply conduit 27 of a lubricant circuit. The lubricant delivery device 26 is embodied by a screw bolt 28 with a central bore 29 and a transverse bore 31; via the bores 29, 31, lubricant can be delivered to a lubricant nozzle 32, which is disposed in a bush 33. The lubricant nozzle 32 is disposed spaced slightly apart from the end face 24 of the roller bolt 22, so that when the lubricant is sprayed, a high quantity of lubricant can be supplied to a bore 30 disposed in the roller bolt 22.

The bore 30 has a portion 34 that is disposed in the bearing axis 23 of the roller bolt 22. The bore portion (34) has a funnel-shaped opening 36, so that when the lubricant nozzle 32 is overtaken during a reciprocating motion, the maximum possible amount of lubricant can get into the bore portion 34 and, via a transverse bore 37, can reach the bearing location between the roller 14 and the roller bolt 22. The bore portion 34 in this exemplary embodiment is embodied as a blind bore.

The lubricant is advantageously sprayed via a nozzle 32, so that a spray field striking the end face 24 substantially has the diameter of the funnel-shaped opening 36. An optimal lubricant delivery can thus be provided.

The lubricant delivery device 26 may be disposed in a plane of a path course of the bore 30 in the region of the entire reciprocating motion to be executed. It is especially advantageous for the lubricant nozzle 32 to be disposed at bottom dead center of the cam path. This makes for a minimal load between the roller 14 and the roller bolt 22, thus allowing improved distribution of the lubricant.

Figure 3:
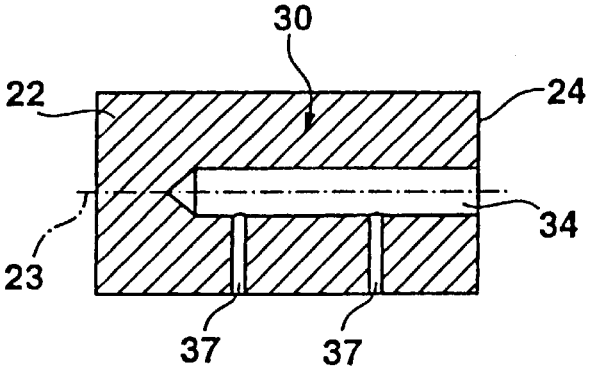
FIG. 3 is a sectional view of a roller bolt supported in the rocker arm in a manner fixed against relative rotation.

FIG. 3 shows a cross section of a roller bolt 22 disposed in a manner fixed against relative rotation in a rocker arm 16. This simple embodiment has a bore portion 34 that is embodied as a blind bore. Discharging into the bore are two radially disposed transverse bores 37, which carry the lubricant to the bearing location between the roller bolt 22 and the roller 14. The transverse bores 37 are embodied in funnel-shaped fashion on an end pointing toward the roller 14, so that the lubricant can emerge over a larger area. Advantageously, such a roller bolt 22 should be installed in such a way that the transverse bore 37 points away from the cam path.

Figure 4:
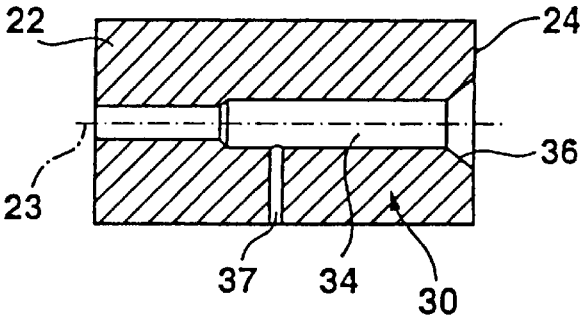
FIG. 4 shows an embodiment of a roller bolt that is an alternative to FIG. 3.

FIG. 4 shows an alternative embodiment of a roller bolt 22 disposed in a manner fixed against relative rotation in the rocker arm 16. The bore 30 has the funnel-shaped opening 36 on one end face 24. The bore 30 is embodied as a stepped bore and protrudes with its increased-diameter portion over at least half the length of the roller bolt 22, so that the transverse bore 37 can be disposed, extending radially outward, approximately in the middle region of the roller bolt 22. As a result of the stepped bore it is possible to achieve good lubricant delivery in the bore portion 34, since no dynamic pressure can build up in the bore portion 34, thus enabling good delivery of the lubricant to the transverse bore 34. The installed position of the roller bolt 22 is equivalent to the installed position described in conjunction with FIG. 3.

As an alternative, it may be provided that in the embodiment of FIG. 4 the bore portion 34 extends over two-thirds or three-quarters of the length of the roller bolt 22, as an example, and a plurality of transverse bores 37 can be disposed, connecting the bore portion 34 to the bearing location.

Figure 5:
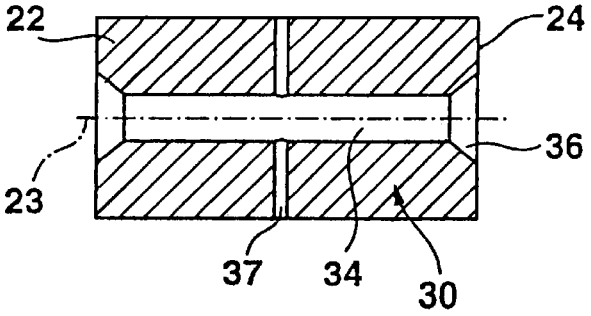
FIG. 5 shows a cross section through a roller bolt supported rotatably in the rocker arm.

FIG. 5 shows a further embodiment of a roller bolt 22, which allows a rotatable support in the rocker arm 16. The bore portion 34 is embodied in continuous fashion, and the transverse bores 37 disposed in the middle region are offset from one another by 180°, thus allowing the delivery of lubricant to two opposed points.

The arrangement shown in FIG. 5 also has the advantage that the roller bolt 22 can be disposed freely selectively with regard to the installation direction, since there is a funnel-shaped opening 36 to the through bore disposed on both face ends.

The transverse bores 37 may also be disposed at an arbitrary angle to one another. A plurality of transverse bores 37 may also be provided either in the same radial plane or in a plurality of radial planes. Advantageously, they are offset from one another by 180°, so that this kind of continuous transverse bore 37 can be produced in a single operation.

Figure 6:
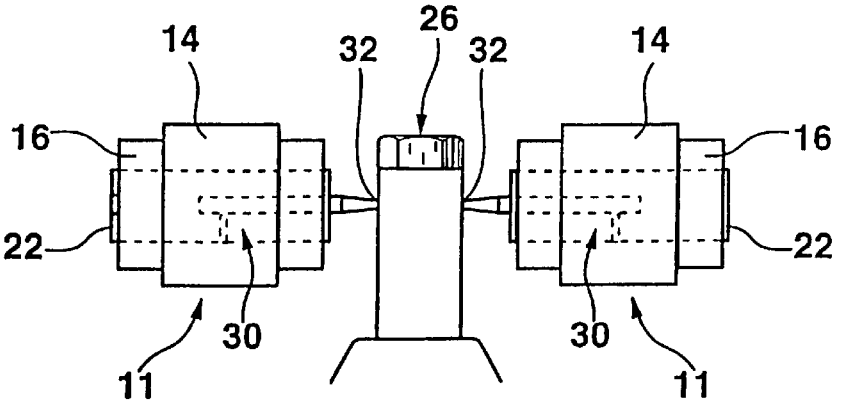
FIG. 6 is a schematic view of a lubricant delivery device disposed between two cam drives.

FIG. 6 shows an alternative embodiment of a lubricant delivery device 26 compared with FIG. 2. This lubricant delivery device 26 has two lubricant nozzles 32, so that when the lubricant delivery device 26 is disposed between two cam drives 11, both cam drives 11 can be supplied with lubricant by means of a single lubricant delivery device 26. As a result of this arrangement, one lubricant delivery device 26 can be provided between every other cam drive 11, as a result of which an inexpensive embodiment can be provided.

As an alternative, it may also be provided that one lubricant delivery device 26 shown in FIG. 6 can be disposed in each interstice between two cam drives 11. In this alternative embodiment, a roller bolt 22 of FIG. 5 is advantageously embodied in the rocker arm 16, so that lubricant can be delivered from both sides.

The embodiment of a cam drive 11 according to the invention may also be provided for an embodiment as an alternative to FIG. 1. In this embodiment, the rocker arm 16 is connected in stationary fashion to the cylinder head on one end via the bearing 17. A camshaft 12 is provided in the middle region of the rocker arm 16 and via cams 13 drives the roller 14 supported in the middle region of the rocker arm. On an end opposite the bearing 17 of the rocker arm 16, the drive element 19 is provided, which triggers a unit fuel injector 21 or the like.

The foregoing relates to preferred exemplary embodiments of the invention, it being understood that other variants and embodiments thereof are possible within the spirit and scope of the invention, the latter being defined by the appended claims.

The invention claimed and desired to be secured by Letters Patent of the United States is:

1. An internal combustion engine comprising a cylinder head, a cam drive (11), a rocker arm (16) pivotably supported in the cylinder head, a roller (14) supported in the rocker arm (16), said roller rolls on a cam path of a cam (13) of a camshaft (12) and is intended for driving a reciprocating component (21), the roller (14) is supported in the rocker arm (16) on a roller bolt (22), said roller bolt includes on at least one face end (24) a bore (30) leading to a bearing point of the roller (14), to which bore lubricant is delivered on the face end upon execution of a reciprocating motion by a lubricant delivery device (26) associated in a region of the reciprocation path executed by the roller bolt.

2. The engine of claim 1, in which the at least one bore (30) has one bore portion (34) extending in a longitudinal axis of the roller bolt (22) and at least one transverse bore (37) extending radially outward of said one bore portion.

3. The engine of claim 1, in which a bore portion (34) of the bore extending in the longitudinal axial direction in the roller bolt (22) extends over at least one-half the length of the roller bolt (22) and is embodied as a blind bore.

4. The engine of claim 2, in which the bore portion (34) extending in the longitudinal axial direction in the roller bolt (22) extends over at least one-half the length of the roller bolt (22) and is embodied as a blind bore.

5. The engine of claim 1, in which a bore portion (34) of the bore extending in the longitudinal axial direction of the roller bolt (22) is embodied as a stepped bore, and a larger diameter portion of the stepped bore extends over at least one-half the length of the roller bolt (22).

6. The engine of claim 2, in which the bore portion (34) extending in the longitudinal axial direction of the roller bolt (22) is embodied as a stepped bore, and a larger diameter portion of the stepped bore extends over at least one-half the length of the roller bolt (22).

7. The engine of claim 1, in which at least one transverse bore (37) of a roller bolt (22) disposed in a manner fixed against relative rotation in the rocker arm (16) is disposed pointing away from the cam path.

8. The engine of claim 2, in which the at least one transverse bore (37) of a roller bolt (22) disposed in a manner fixed against relative rotation in the rocker arm (16) is disposed pointing away from the cam path.

9. The engine of claim 3, in which at least one transverse bore (37) of a roller bolt (22) disposed in a manner fixed against relative rotation in the rocker arm (16) is disposed pointing away from the cam path.

10. The engine of claim 5, in which at least one transverse bore (37) of a roller bolt (22) disposed in a manner fixed against relative rotation in the rocker arm (16) is disposed pointing away from the cam path.

11. The engine of claim 1, in which at least one transverse bore (37) of a roller bolt (22) supported rotatably in the rocker arm (16) is embodied as at least one bore that completely crosses through the roller bolt (22).

12. The engine of claim 2 in which the at least one transverse bore (37) of a roller bolt (22) supported rotatably in the rocker arm (16) is embodied as at least one bore that completely crosses through the roller bolt (22).

13. The engine of claim 3, in which at least one transverse bore (37) of a roller bolt (22) supported rotatably in the rocker arm (16) is embodied as at least one bore that completely crosses through the roller bolt (22).

14. The engine of claim 5, in which at least one transverse bore (37) of a roller bolt (22) supported rotatably in the rocker arm (16) is embodied as at least one bore that completely crosses through the roller bolt (22).

15. The engine of claim 1, in which the lubricant delivery device (26) is disposed substantially in a region in which the roller (14) passes through a bottom dead center position of the cam (13).

16. The engine of claim 1, in which the lubricant delivery device (26) has at least one lubricant nozzle (32), which can be made to communicate with a lubricant supply conduit (27) of a lubricant circuit in the cylinder head.

17. The engine of claim 16, in which the lubricant delivery device (26) has two lubricant nozzles (32), offset from one another by 180°, which can be disposed between two rollers (14), each rolling on a respective cam path, of a cam drive (11).

18. The engine of claim 1, in which a bore portion (34) of the bore oriented toward the lubricant delivery device (26) has a funnel-shaped opening (36).

19. The engine of claim 1, in which at least one transverse bore (37) communicating with a bore portion (34) of the bore is provided, the transverse bore discharges in a region of a coincidence of the roller bolt (22) with the rocker arm (16).

20. The engine of claim 2, in which the transverse bore discharges in a region of a coincidence of the roller bolt (22) with the rocker arm (16).

* * * * *